US005342057A

United States Patent [19]

Sorkoram

[11] Patent Number: 5,342,057

[45] Date of Patent: Aug. 30, 1994

[54] INTERACTIVE, TABLETOP SIGNAGE ASSEMBLY

[76] Inventor: Paul O. Sorkoram, 26920 M-60, Mendon, Mich. 49072-0428

[21] Appl. No.: 11,729

[22] Filed: Feb. 1, 1993

[51] Int. Cl.[5] ..... A63F 3/00; G09F 23/14; G09F 23/08; G09F 23/06

[52] U.S. Cl. ..... 273/239; 273/287; 273/271; 273/345; 273/402; 40/661; 40/5; 40/156

[58] Field of Search ..... 273/287, 239, 459, 265, 273/148 R, 269, 285, 306, 141 R, 271, 336, 345, 338, 353, 398, 400–402, 459; 40/661, 5, 156

[56] References Cited

U.S. PATENT DOCUMENTS 3,093,919 6/1963 Holtz ..... 273/239
3,820,262 6/1974 Dewsnap ..... 40/661
3,956,837 5/1976 Itano ..... 40/661
4,432,151 2/1984 Morris ..... 40/661
4,678,188 7/1987 Johnson ..... 273/141 R

*Primary Examiner*—Benjamin H. Layno
*Attorney, Agent, or Firm*—Krass & Young

[57] ABSTRACT

A signage assembly useful for the tabletop display of an advertising message. The assembly includes a holder comprised of an upright into which the insert may be removably inserted and a base for supporting the upright upon the tabletop. An interactive device for engaging an observer, preferably in the form of a game board, disposed upon the base so that the observer will read the message printed on the insert while playing the game.

14 Claims, 2 Drawing Sheets

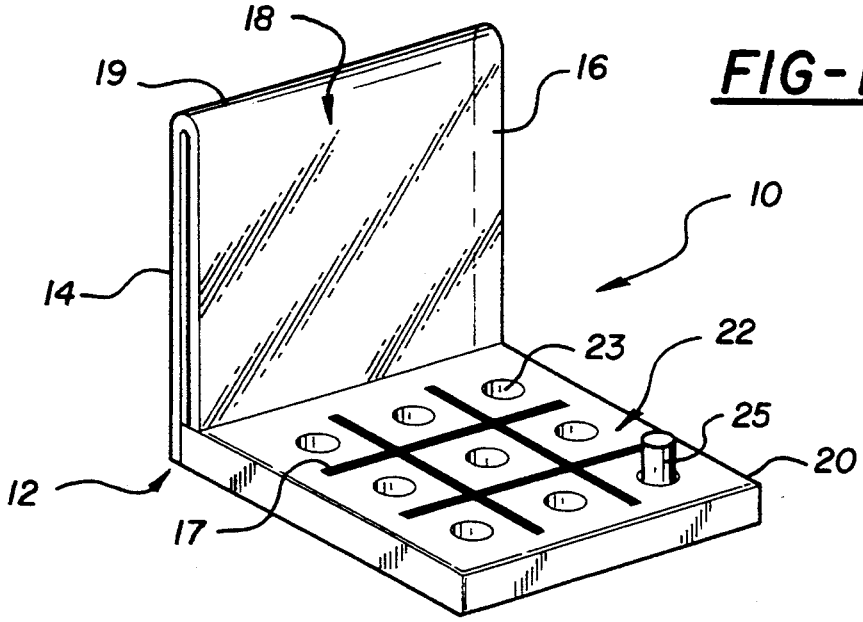
FIG-1
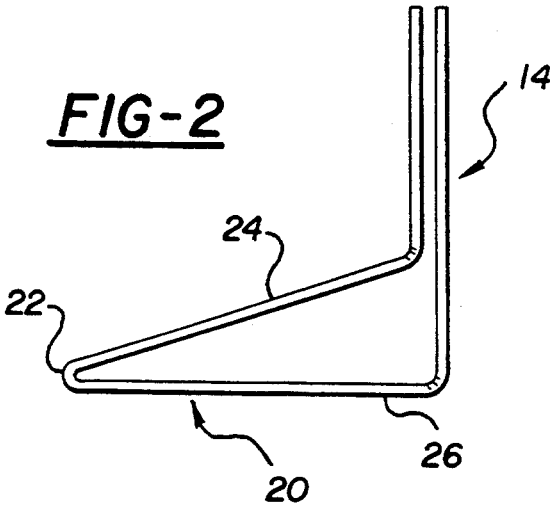
FIG-2
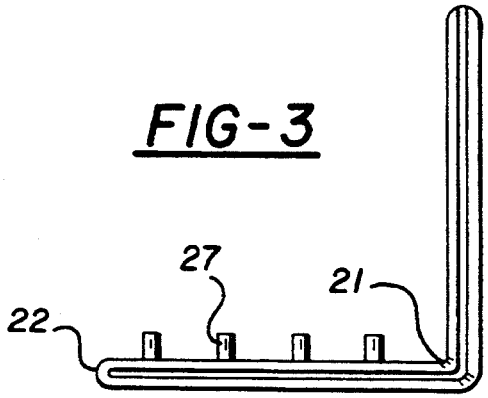
FIG-3
FIG-6
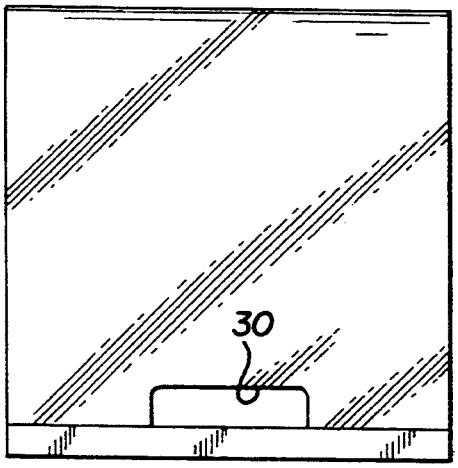
FIG-7
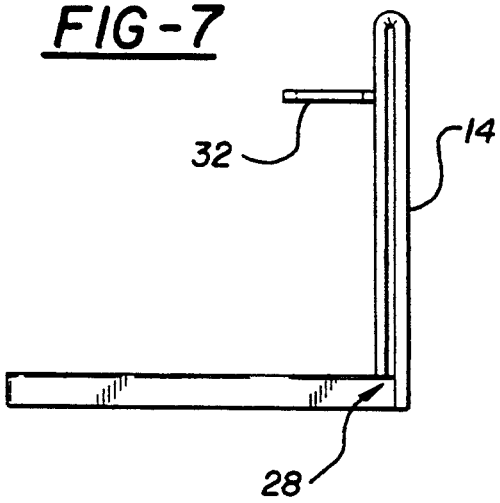

INTERACTIVE, TABLETOP SIGNAGE ASSEMBLY

FIELD OF THE INVENTION

This invention concerns the field of assemblies for retaining signs and, more particularly, to such an assembly which may be placed on a tabletop.

DESCRIPTION OF THE RELEVANT PRIOR ART

It has become a common practice for establishments such as restaurants and bars to use a tabletop signage assembly to display various messages to their customers, such as the daily menu or advertising for various food or beverage items served in the establishment. Previously, metal assemblages were employed for this purpose which included a base for supporting the sign on the table, and a metal frame or metal prongs into which a removable advertising message could be inserted.

In more recent years, signage assemblies employing transparent, polymeric materials have come into widespread usage. Typically, the prior art polymeric signage assembly includes a double-walled upright portion into which the advertising message or menu may be inserted which is bent outwardly at its lower end to form a base.

The problem with the prior art signage assemblies is, of course, that customers in the restaurant frequently tend to ignore them since there is normally a fair amount of clutter atop a restaurant table, including napkin holder, salt and pepper containers, sugar and artificial sweetener containers, flower or other decoration, etc. Such signage tends to get lost in the clutter and is easily ignored. Obviously, there is no point in having tabletop signage if many of the customers ignore it.

Accordingly, there is a need for a tabletop signage assembly which will attract the customers' attention and cause them to read the message carried by the signage assembly. It would be especially advantageous for such a signage assembly to attract the customers' attention for a relatively long period of time so that the message may be thoroughly absorbed. It would, of course, be even more advantageous if such a signage assembly attracted the customers' attention and entertained them while they were waiting for their meals.

SUMMARY OF THE INVENTION

Disclosed and claimed herein is an interactive, tabletop signage assembly which includes a holder for displaying an insert carrying a message to be read by an observer, such as a restaurant customer, on at least one face thereof. The holder includes an upright for releasably retaining the insert therein and for displaying said at least one face so that the observer may read the message. The holder also includes a base for supporting the upright on a surface of a table. Means are disposed on the base for interactively engaging the observer with the holder such that the observer's attention is drawn to the message.

Typically, the upright of the holder is formed or molded of transparent polymeric sheet material, such as acrylic, polyethylene terathalate (PET), PETG (gylcol modified PET copolyester), or any other suitable transparent, moldable polymer. In one embodiment of the signage assembly of the present invention, a single sheet of polymer is used which is folded back upon itself to form a double-walled sheet. The double-walled sheet is then bent to form two right-angled sections, one section being the base of the assembly, and the other section being the upright. In a modification, the fold line may form one edge of the base, and the folded back portion of the polymeric sheet may diverge angularly from the other portion, thus giving the base an upper, sloping surface. In another version, the entire holder, including base and upright may be injection molded, or the two components may be separately molded.

Alternatively, the base may be formed of a solid block of polymeric material, with the upright glued to an edge thereof. Again, the upright may be formed of a single sheet of polymeric material doubled back upon itself to create a double-walled upright into which the advertising insert may be inserted, or a pair of spaced apart sheets may be used to form the upright.

Typically, the means for interactively engaging the observer includes a game playing field formed on the base of the assembly. The game playing field may take a variety of embodiments, including a plurality of holes formed in the base and configured to receive game tokens. Games such as tic-tac-toe, checkers, pegboard games, etc. may be played upon such a game playing field. Alternatively, a game playing field may be printed or otherwise disposed upon the base of the assembly and tokens provided for playing a particular game. In this version, it is desirable that the base be provided with a plurality of bodies formed of polymeric magnetic material so that metallic playing pieces, such as checkers, may be attached thereto and moved thereon. In some cases, an auxiliary structure, such as a spinner, a hoop, or an embedded ball may be attached to the assembly, either on the base or on the upright, depending on the game which is to be played. For example, a small hoop may be attached to the upright to play a game of miniature basketball, a spinning arrow may be attached to the base as part of a board game, or an embedded ball may be part of a maze game.

In another embodiment, the base extends in both directions from the upright and an opening is provided through the upright near the bottom edge thereof so that one or more playing pieces may be passed back and forth through the upright. Games such as miniature shuffleboard or hockey may be played upon this version.

BRIEF DESCRIPTION OF THE DRAWINGS

The following detailed description is best understood by reference to the following drawings, in which:

FIG. 1 is a perspective view of one embodiment of a signage assembly constructed according to the present invention;

FIG. 2 is a side view of another embodiment of a signage assembly of the present invention;

FIG. 3 is a side view of yet another embodiment of a signage assembly according to the present invention;

FIG. 6 is a front view of the embodiment shown in FIG. 4; and

FIG. 7 is a side view of still another embodiment of a signage assembly according to the present invention.

DETAILED DESCRIPTION OF THE PREFERRED EMBODIMENTS

Figure 4:
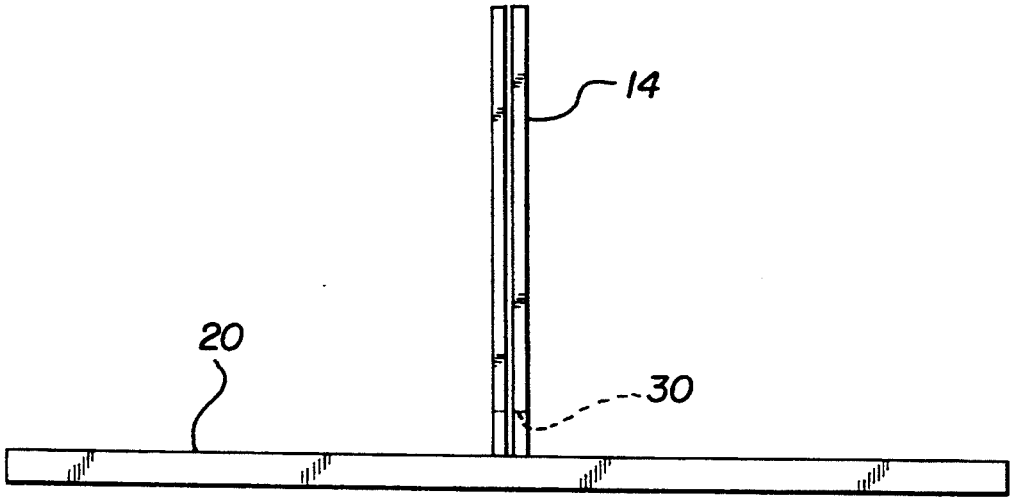
FIG. 4 is a side view of still another embodiment of a signage assembly according to the present invention.

Throughout the following detailed description, like references numerals are used to reference the same element of the invention shown in multiple figures thereof. Referring now to the drawings and in particular to FIG. 1, there is shown a signage assembly 10 according to the present invention suitable for tabletop display of advertising or the like. The signage assembly 10 comprises a holder 12 including an upright 14 which is configured to receive an insert 16 having a message 18 to be read by an observer appearing on a face thereof. The holder 12 further includes a base 20 for supporting the upright 14 on a surface of a table (not shown).

Means 22 are disposed on the base 20 base for interactively engaging an observer (such as a restaurant customer if the signage assembly is on top of a restaurant table) with the holder 12 such that the observer's attention is drawn to the message 18. In the embodiment depicted in FIG. 1, the means 22 for interactively engaging the observer consists of a game playing field in the form of a tic-tac-toe playing board. Thus, the top of the base 22 includes division lines 17 for the tic-tac-toe game, as well as apertures 23 which are configured to retain a playing piece, such as a peg 25, therein. By providing a plurality of pegs 25, two people can interactively play a tic-tac-toe game on base 20. Optionally, game instructions may also be imprinted or otherwise disposed on the base 20.

In the embodiments shown in FIGS. 1 and 6, the upright is formed of a single sheet of a transparent, polymeric material which is folded over along its upper edge 19 to form a double-walled structure. The insert 16 may then be removably inserted into the space created by the double-walled structure. The upright 14 thus formed is simply glued to the base 20 along a lower edge of the upright 14. Of course, two pieces of polymeric sheet material could be used to form the upright 14, in which case both would be glued to the base 20.

FIGS. 2 and 3 depict alternate embodiments of the signage assembly of the present invention. In the embodiment depicted in FIG. 2, a single sheet of transparent, polymeric material is used to form both the base 20 and the upright 14. By bending the sheet along suitable fold lines, the configurations shown in FIGS. 2 and 3 are created. In FIG. 3, both the base and upright are double-walled structures created by folding the sheet back upon itself along fold line 22, and subsequently folding the double sheet along right angle fold 21. In the embodiment depicted in FIG. 2, the sheet is bent along fold line 22 but an upper surface 24 of the base 20 angularly diverges from a lower surface 26 thereof, although, again, the upright 14 has a parallel, double-walled configuration. Depending upon the interactive means which is to be disposed on the base, one of the embodiments depicted in FIGS. 2 and 3 may be particularly suitable.

Figure 5:
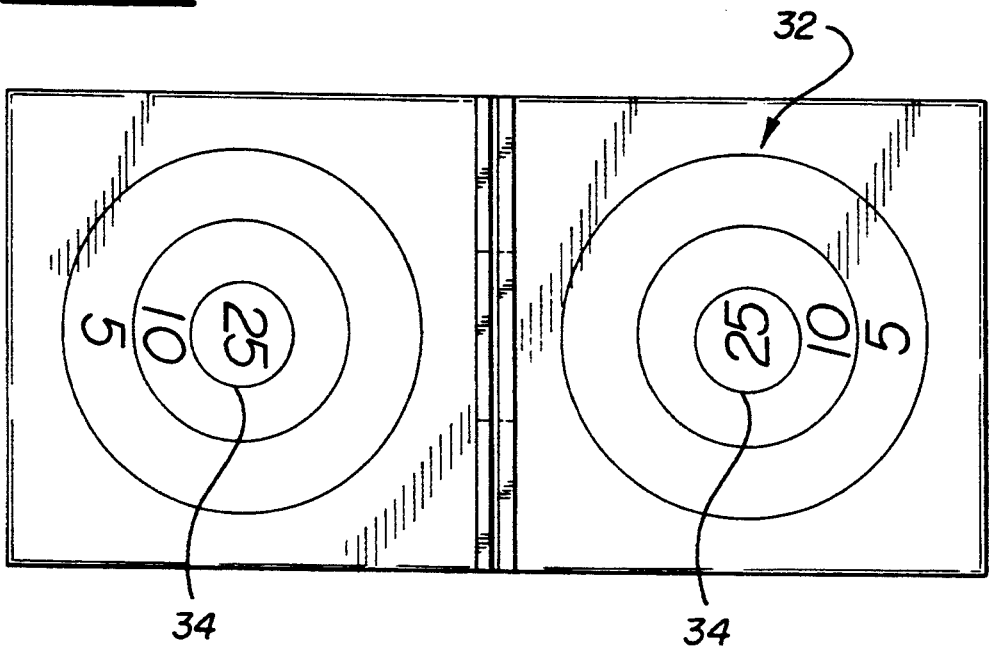
FIG. 5 is a top plan view of the signage assembly of FIG. 4.

Still another embodiment of the signage assembly of the present invention is shown in FIGS. 4, 5 and 6. In this case, the base 20 extends from both surfaces of upright 14, to create a sort of double playing field. As can be seen in FIG. 5, indicia 32, in this case suitable for playing a shuffleboard-type of game, may be printed or otherwise disposed upon the base 20. So that playing pieces may pass from one side of the base 20 to the other, an opening 30, best seen in FIG. 6, is formed in upright 14.

The signage assembly may include other designs and embellishments; other playing features may be attached to either the base or the upright, such as is depicted in FIG. 7. In this case, a hoop 32 is attached to upright 14 so that an aiming game, such as miniature basketball, may be played upon the signage assembly.

Rather, than the apertures 23 formed in the base 20 and depicted in FIG. 1, the base 20 may be provided with a plurality of bodies of magnetic, polymeric material (referenced in FIG. 5 by numeral 34) so that a magnetic playing piece will adhere thereto. In the shuffleboard-type game depicted in FIG. 5, the central portion or bulls-eye is formed by the magnetic body 34 so that a magnetic playing piece will adhere thereto. Of course, bodies of magnetic material could be disposed to allow the playing of such games as checkers, or tic-tac-toe. In another alternate embodiment, shown in FIG. 3, the base is formed to include a plurality of upwardly projecting pegs 27. The pegs 27 receive a plurality of apertured game tokens which may be moved around from peg to peg to play a game.

In contrast to prior art tabletop signage assemblies, the present invention is far less likely to be ignored by observers. Normally, customers in a bar or restaurant spend a fair amount of time waiting for service, the arrival of food or drink, etc. Many would enjoy the opportunity to play a tabletop game during these waiting periods. By disposing the game field upon the signage base, the customer's attention is drawn to and held by the signage assembly, thus causing the customer to not only read, but also to concentrate, on the message displayed therein. Thus, the customer is far more likely to both read and, more importantly, retain whatever message is displayed within the signage assembly. Moreover, by its compact design, the present invention does not clutter the tabletop to any greater degree than prior art signage. Furthermore, it is inexpensive and easy to manufacture. Some embodiments may be simply formed by making suitable bends in sheets of transparent, polymeric material, such as acrylic, polycarbonate, PET or PETG. In other embodiments, the upright and base may be injection molded, either separately or together as one piece. For example, the base may be injection molded for a maze game which employs one or more small balls embedded, but movable in the maze.

The foregoing detailed description has illustrated and described certain embodiments and exemplifications of the herein invention. Other design variations may occur to one skilled in the art upon reading and considering the present disclosure. The present invention is not intended to be limited to the embodiments and exemplifications depicted. For example, other games than shuffleboard, tic-tac-toe and basketball may be advantageously employed as the interactive engagement means of the present invention; for example, simplified board-type games involving random moves determined by the results of spinning an arrow may be employed with the signage of the present invention. All of these design variations are considered to be within the scope of the invention which is defined solely by the claims appended hereto and all reasonable equivalents thereof.

I claim:

1. An interactive, tabletop signage assembly comprising:

an L-shaped holder for displaying an insert carrying a message to be read by an observer, said holder including an upright for releasably receiving said insert and including an upright for releasably receiving said insert and displaying opposed faces thereof, and a base perpendicular to said upright for supporting said upright on a surface of a table; and means attached to said base for interactively engaging said observer with said holder such that the observer's attention is drawn to the message. wherein the upright is formed of two opposed sheets of transparent, polymeric material substantially coextensive with said insert and spaced apart from each other so as to receive and retain said insert such that both faces of said insert are visible.

2. The assembly of claim 1 wherein said upright is attached to said base along a bottom edge of said upright.

3. The assembly of claim 1 wherein said holder is formed of a single sheet of transparent, polymeric material.

4. The assembly of claim 3 wherein said sheet is bent back upon itself along a fold line and the holder is configured as a double walled L, the leg of the L forming the base of the holder.

5. The assembly of claim 4 wherein an upper wall of the base of the holder diverges from a lower wall thereof at said fold line.

6. The assembly of claim 1 wherein the means for interacting with the observer includes a game playing field formed on said base.

7. The assembly of claim 6 wherein said game playing field includes a plurality of holes formed in said base and configured to receive at least one game token therein.

8. The assembly of claim 6 wherein said game playing field further includes a plurality of polymeric magnet material bodies mounted on said base for attachment of at least one magnetic playing piece thereto.

9. The assembly of claim 6 wherein said game playing field further includes a plurality of upright pegs configured to receive at least one apertured game token thereon.

10. The assembly of claim 6 wherein the playing field is formed of indicia disposed on an upper surface of said base.

11. The assembly of claim 6 wherein the playing field further includes a portion mounted upon said upright.

12. The assembly of claim 1 wherein said upright has two opposed faces and said base extends horizontally from one of said opposed faces.

13. The assembly of claim 12 wherein said base further extends horizontally from both opposed faces of said upright.

14. The assembly of claim 13 wherein said upright further includes a cut out portion proximate said bottom edge for passage of a playing piece therethrough.

* * * * *